US010815724B2

(12) United States Patent
Yang

(10) Patent No.: US 10,815,724 B2
(45) Date of Patent: Oct. 27, 2020

(54) DOUBLE-LAYER ROMAN SHADE FOLDING STRUCTURE

(71) Applicant: Sen-Hsu Yang, Taipei (TW)

(72) Inventor: Sen-Hsu Yang, Taipei (TW)

( * ) Notice: Subject to any disclaimer, the term of this patent is extended or adjusted under 35 U.S.C. 154(b) by 0 days.

(21) Appl. No.: 16/208,610

(22) Filed: Dec. 4, 2018

(65) Prior Publication Data

US 2020/0173227 A1 Jun. 4, 2020

(51) Int. Cl.

| | |
|---|---|
| ***E06B 9/262*** | (2006.01) |
| ***A47H 1/13*** | (2006.01) |
| ***E06B 9/44*** | (2006.01) |

(52) U.S. Cl.

CPC ..... *E06B 9/262* (2013.01); *A47H 1/13* (2013.01); *E06B 9/44* (2013.01); *E06B 2009/2622* (2013.01)

(58) Field of Classification Search

CPC ..... E06B 2009/2622; E06B 9/44

See application file for complete search history.

(56) References Cited

U.S. PATENT DOCUMENTS

| | | | | |
|---|---|---|---|---|
| 8,113,261 | B2 * | 2/2012 | Lin | E06B 9/262 160/108 |
| 2012/0067527 | A1 * | 3/2012 | Cheng | E06B 9/262 160/84.02 |
| 2012/0267056 | A1 * | 10/2012 | Ko | A47H 23/01 160/84.04 |
| 2013/0340950 | A1 * | 12/2013 | Lin | E06B 9/262 160/84.08 |

OTHER PUBLICATIONS

Staggered, accessed Mar. 18, 2020 from https://dictionary.cambridge.org/us/dictionary/english/staggered (Year: 2020).*

* cited by examiner

*Primary Examiner* — Katherine W Mitchell
*Assistant Examiner* — Jeremy C Ramsey

(57) ABSTRACT

A double-layer Roman shade folding structure includes a bracket. The bracket is provided with an outer curtain fabric, a roller tube, and an inner curtain fabric. The outer curtain fabric is provided with a plurality of strip-shaped limiting members that are arranged horizontally and spaced apart at equal intervals. An opening is defined between the limiting members and the outer curtain fabric for the inner curtain fabric to pass therethrough. When the bottom end of the inner curtain fabric drives the bottom end of the outer curtain fabric to be moved up, the plurality of limiting members are pushed and moved up in sequence so that the outer curtain fabric is folded and overlapped continuously.

6 Claims, 7 Drawing Sheets

DOUBLE-LAYER ROMAN SHADE FOLDING STRUCTURE

FIELD OF THE INVENTION

The present invention relates to a window shade, and more particularly to a double-layer Roman shade folding structure which can stably support and drive the Roman shade to be folded and overlapped upward. The double-layer Roman shade folding structure comprises a bracket, an outer curtain fabric, a roller tube, an inner curtain fabric, and a plurality of strip-shaped limiting members.

BACKGROUND OF THE INVENTION

A Roman shade uses a roller tube to roll an inner curtain fabric to move an outer curtain fabric up and down for extending and retracting the outer curtain fabric, which is known in the art, as disclosed in U.S. Pat. No. 8,113,261. The folding structure of this Roman shade uses U-shaped rings to clamp and retain the respective two side edges of the outer curtain fabric and the inner curtain fabric. In this way, when the roller tube winds the inner curtain fabric upward, the inner curtain fabric moves the outer curtain fabric up through the U-shaped rings.

However, because the U-shaped ring of the above-mentioned Roman shade is configured to clamp the respective side edges of the outer curtain fabric and the inner curtain fabric, one end of the U-shaped ring is exposed on the side of the outer curtain fabric to affect the appearance. In addition, in order to move the inner curtain fabric smoothly between the inner surface of the outer curtain fabric and the U-shaped ring, the U-shaped ring cannot clamp the outer curtain fabric and the inner curtain fabric too tightly. As a result, when the inner curtain fabric and the outer curtain fabric are relatively moved, the U-shaped ring is likely to fall off, and the Roman shade cannot be folded. Moreover, when the U-shaped rings at both sides of the outer curtain fabric and the inner curtain fabric are installed, the heights of the U-shaped rings on both sides may be inconsistent. The adjustment must be repeated up and down. The assembly is time-consuming and difficult.

Accordingly, the inventor of the present invention has devoted himself based on his many years of practical experiences to solve these problems and provide a double-layer Roman shade folding structure.

SUMMARY OF THE INVENTION

The primary object of the present invention is to provide a double-layer Roman shade folding structure, comprising a bracket, a roller tube, an inner curtain fabric, an outer curtain fabric, and a plurality of strip-shaped limiting members. The roller tube is pivotally connected to an inner side of the bracket. The inner curtain fabric has a top end fixed to the roller tube and a bottom end extendable to be placed under the bracket. The outer curtain fabric has a top end fixed to a front side of the bracket and a bottom end extendable to be placed under the bracket. The bottom end of the inner curtain fabric is fixed to an upper edge of the bottom end of the outer curtain fabric. The outer curtain fabric is provided with a plurality of first fold line portions that are arranged horizontally and spaced apart from each other. A plurality of second fold line portions that are arranged horizontally and spaced apart from each other are disposed between the top end of the outer curtain fabric, the plurality of first fold line portions and the bottom end of the outer curtain fabric. The plurality of first fold line portions and the plurality of second fold line portions are arranged at equal intervals in a staggered manner. The limiting members are detachably disposed on a surface facing the inner curtain fabric of the plurality of first fold line portions respectively so that an opening is defined between the surface of each of the first fold line portions and a corresponding one of the limiting members for the inner curtain fabric to pass therethrough. The roller tube enables the bottom end of the outer curtain fabric to be pulled upward through the bottom end of the inner curtain fabric. When the bottom end of the inner curtain fabric is moved up to the plurality of openings, the plurality of the limiting members and the plurality of first fold line portions of the outer curtain fabric are pushed and moved up in sequence from bottom to top, and the outer curtain fabric is folded along the plurality of second fold line portions so that the outer curtain fabric is formed in a state of continuous parallel folding.

With the above structure, the plurality of limiting members can be installed on the inner surface of the outer curtain fabric quickly and easily, and the plurality of limiting members are not exposed on the outer surface of the outer curtain fabric to enhance the appearance. When in use, the roller tube enables the bottom end of the outer curtain fabric to be pulled upward through the bottom end of the inner curtain fabric. The plurality of the limiting members and the plurality of first fold line portions of the outer curtain fabric are pushed and moved up in sequence from bottom to top, and the outer curtain fabric is folded along the plurality of second fold line portions so that the outer curtain fabric is formed in a state of continuous parallel folding, thereby folding the Roman shade stably. The present invention improves the shortcomings of the prior art, for example, the U-shaped ring of the conventional Roman shade is easy to affect the appearance, the assembly is time-consuming, and the stability is not good at the time of folding.

Embodiments of the present invention will now be described, by way of example only, with reference to the accompanying drawings.

DETAILED DESCRIPTION OF THE PREFERRED EMBODIMENTS

Figure 1:
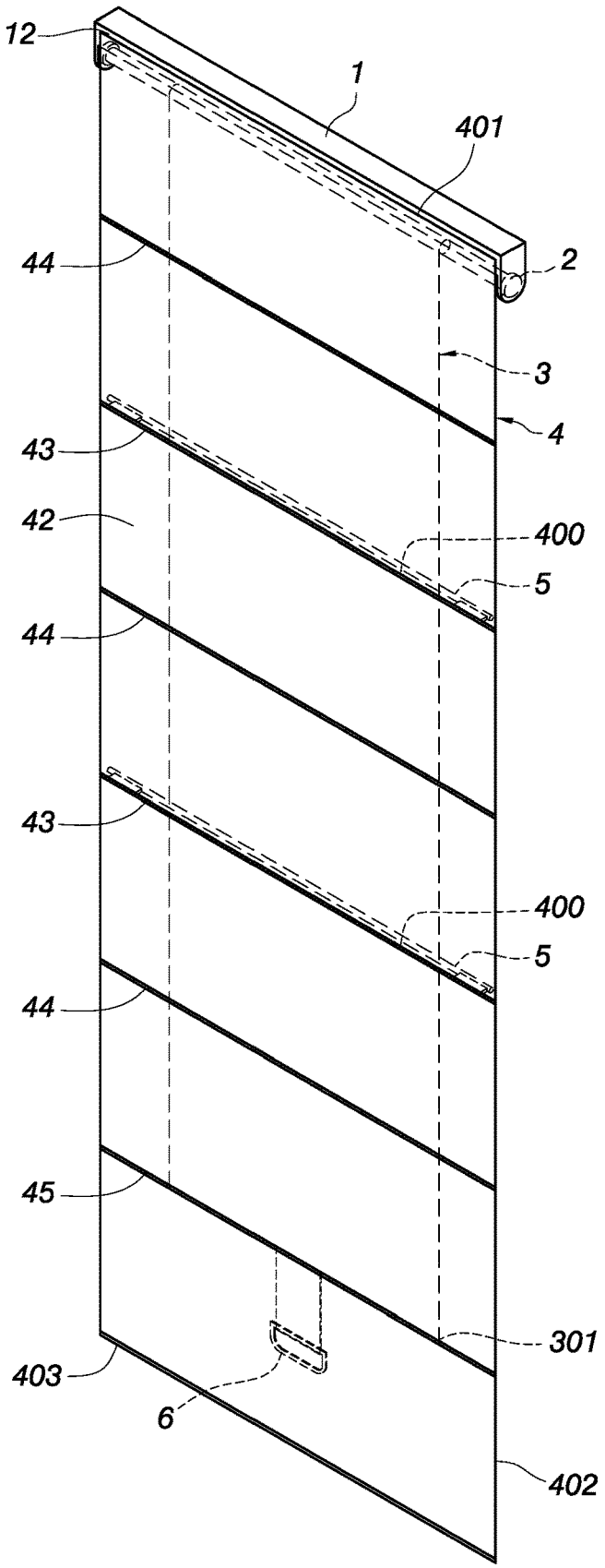
FIG. 1 is a perspective view in accordance with a preferred embodiment of the present invention.
Figure 2:
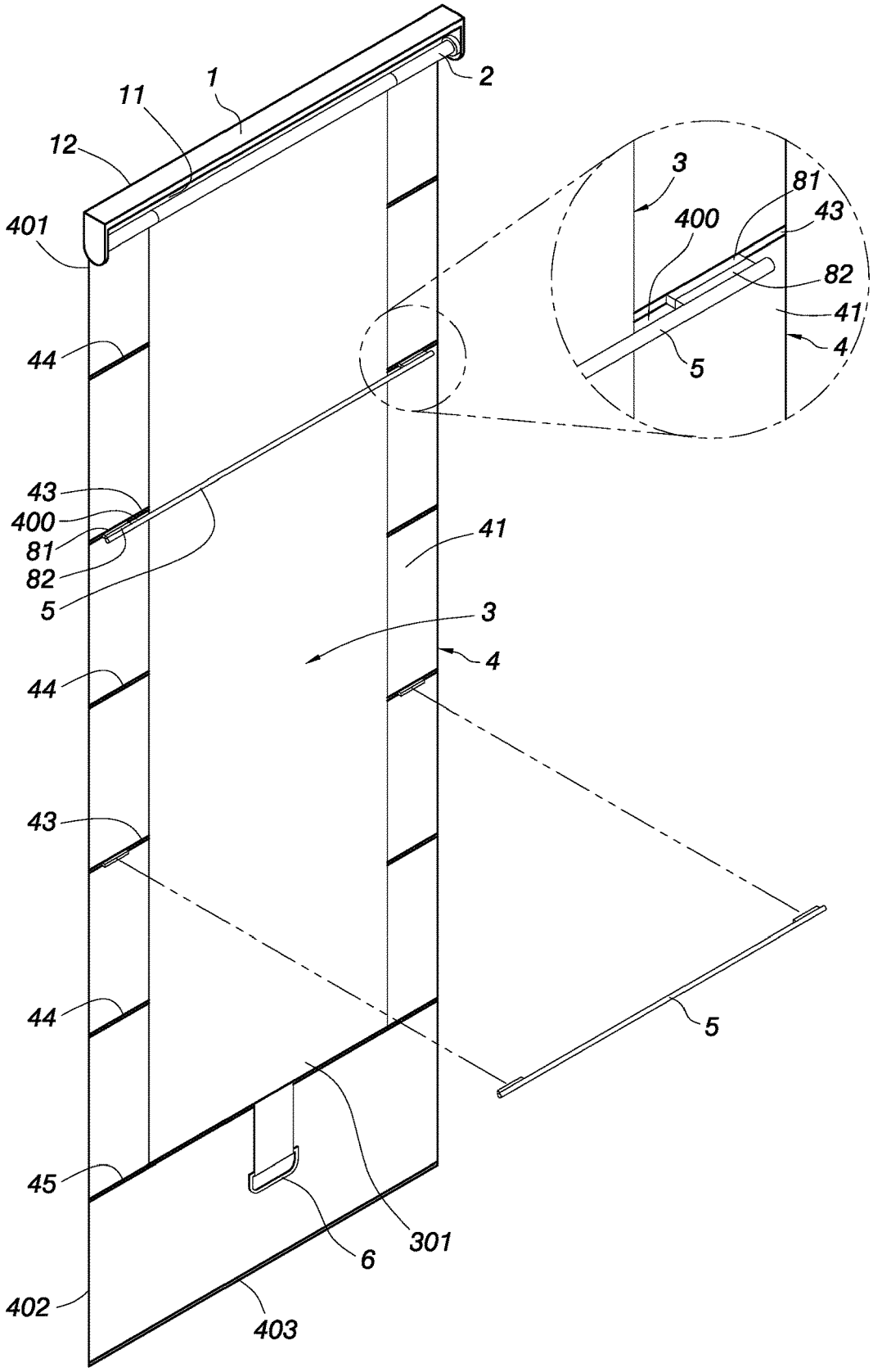
FIG. 2 is a partial exploded and perspective view of FIG. 1.

Referring to FIG. 1 to FIG. 4, a double-layer Roman shade folding structure in accordance with a preferred embodiment of the present invention comprises a bracket 1, a roller tube 2, an inner curtain fabric 3, an outer curtain fabric 4, and a plurality of strip-shaped limiting members 5. The bracket 1 has a rectangular shape, having an inner side 11 and an outer side 12 opposite to the inner side 11. The roller tube 2 is pivotally connected to the inner side 11 of the bracket 1. A top end of the inner curtain fabric 3 is fixed to the roller tube 2. A bottom end 301 of the inner curtain fabric 3 is extendable to be placed under the bracket 1. The bottom end 301 of the inner curtain fabric 3 is provided with a pull ring 6.

The outer curtain fabric 4 has an inner surface 41 facing the inner curtain fabric 3 and an outer surface 42 facing away from the inner curtain fabric 3. A top end 401 of the outer curtain fabric 4 is fixed to the outer side 12 of the bracket 1. A bottom end 402 of the outer curtain fabric 4 is extendable to be placed under the bracket 1. The bottom end 301 of the inner curtain fabric 3 is fixed to an upper edge of the bottom end 402 of the outer curtain fabric 4. The outer curtain fabric 4 is provided with a plurality of first fold line portions 43 that are arranged horizontally and spaced apart from each other. A plurality of second fold line portions 44 that are arranged horizontally and spaced apart from each other are disposed between the top end 401 of the outer curtain fabric 4, the plurality of first fold line portions 43 and the bottom end 402 of the outer curtain fabric 4, so that the plurality of first fold line portions 43 and the plurality of second fold line portions 44 are arranged at equal intervals in a staggered manner.

Specifically, the upper edge of the bottom end 402 of the outer curtain fabric 4 is provided with a third fold line portion 45. The bottom end 301 of the inner curtain fabric 3 is connected to the third fold line portion 45 of the outer curtain fabric 4.

Figure 3:
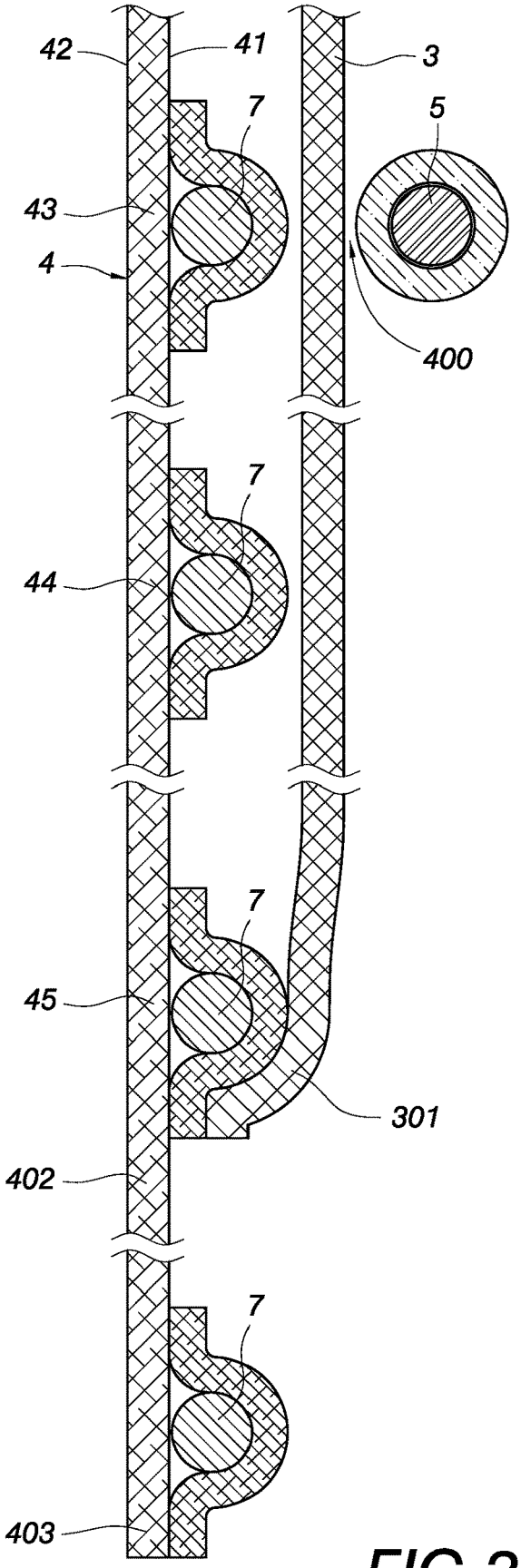
FIG. 3 is a partial sectional view of FIG. 2.
Figure 4:
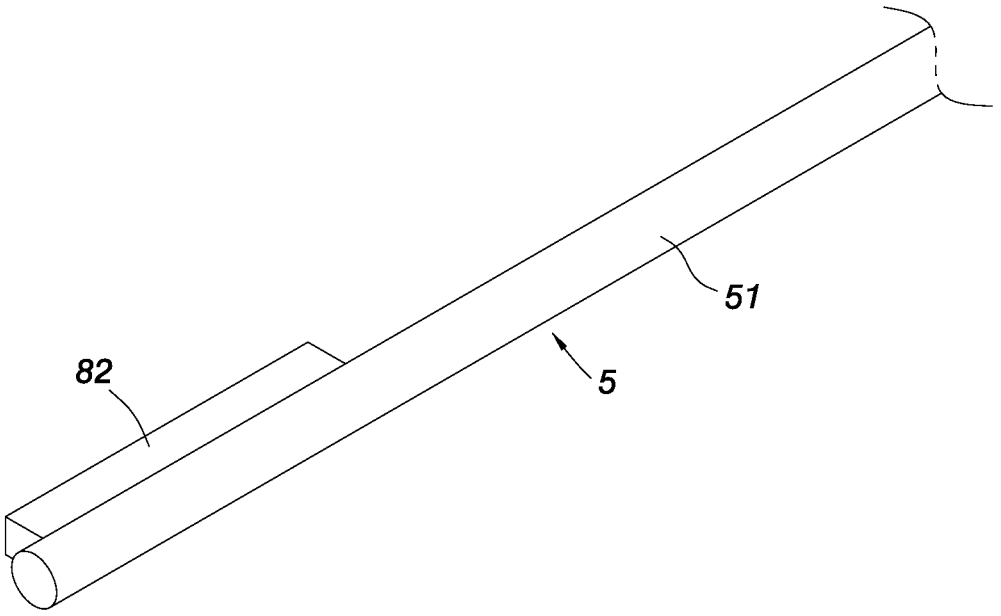
FIG. 4 is a partial enlarged view of the limiting member of FIG. 2.

As shown in FIG. 3, in an embodiment, each of the plurality of first fold line portions 43, the plurality of second fold line portions 44, the third fold line portion 45 and a bottom edge 403 of the outer curtain fabric 4 is provided with a rod-shaped ballast member 7.

As shown in FIG. 2 to FIG. 5, in the preferred embodiment, the plurality of limiting members 5 are detachably disposed at the plurality of first fold line portions 43 on the inner surface 41 facing the inner curtain fabric 3 of the outer curtain fabric 4. An opening 400 is defined between the inner surface 41 of the plurality of first fold line portions 43 of the outer curtain fabric 4 and a corresponding one of the limiting members 5 for the inner curtain fabric 3 to pass therethrough. In detail, two side ends of each of the first fold line portions 43 of the inner surface 41 facing the inner curtain fabric 3 of the outer curtain fabric 4 are provided with connecting members 81. Two ends of the corresponding limiting member 5 are provided with connected members 82. The limiting member 5 is connected to the connecting member 81 of the inner curtain fabric 3 through the connected member 82. The connecting member 81 and the connected member 82 may be a hook-and-loop fastener, a buckle or a clip.

Preferably, the plurality of strip-shaped limiting members 5 may be fiberglass rods 51 to strengthen the structure of the limiting members 5.

Figure 5:
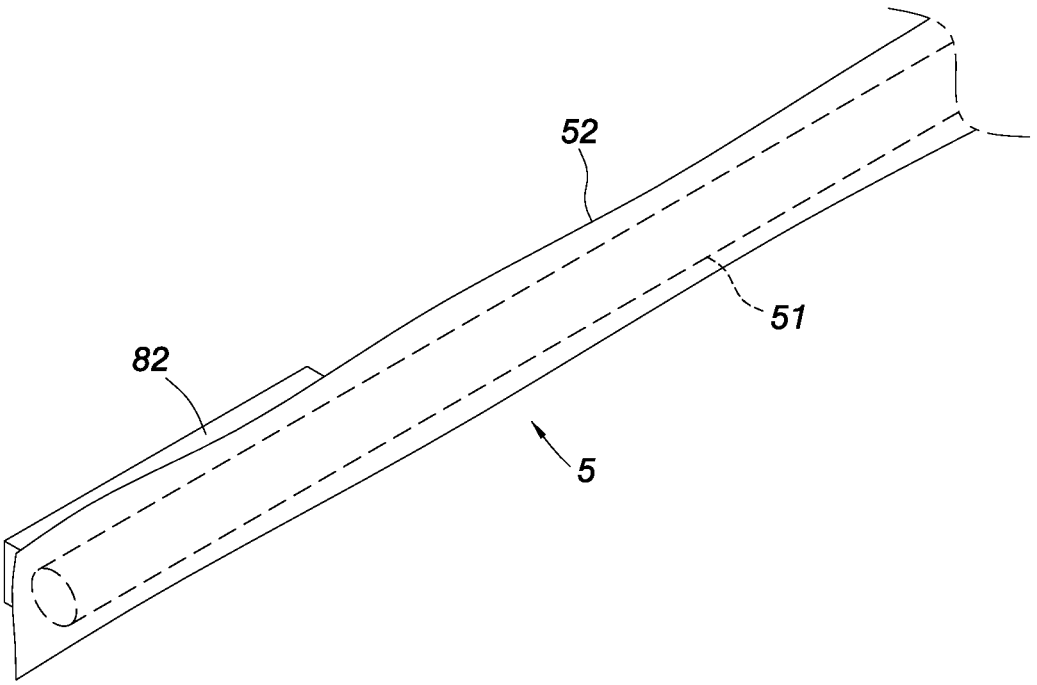
FIG. 5 is a perspective view of an additional embodiment of FIG. 3.

Referring to FIG. 5, in another feasible embodiment, each of the plurality of limiting members 5 may be a fabric strip 52 or a fiberglass rod 51 wrapped with a fabric strip 52. The connected members 82 are disposed at an outer wall of the fabric strip 52 relative to the two ends of the limiting member 5, which facilitates combining the connected members 82 at the two ends of the limiting member 5.

Figure 6:
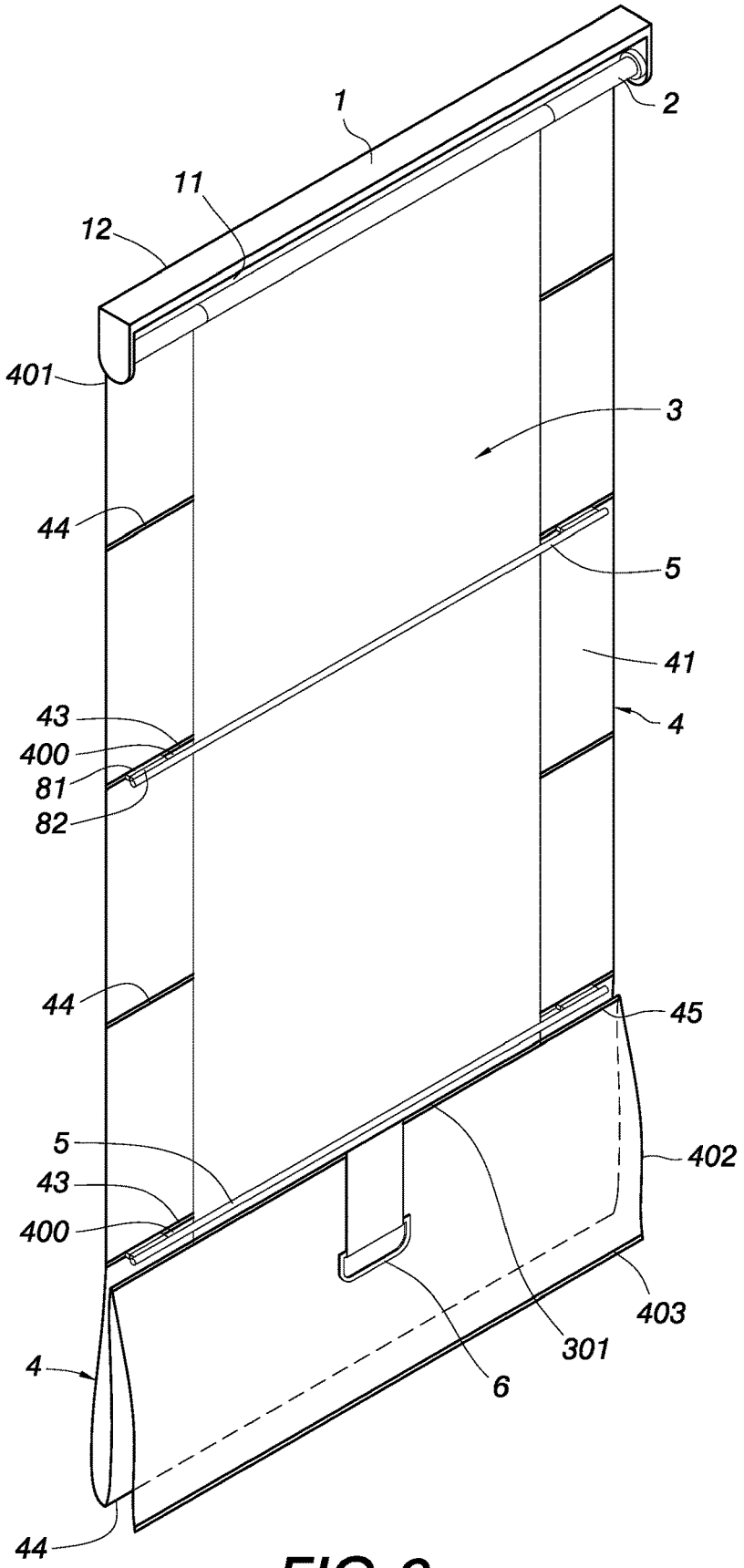
FIG. 6 is a perspective view of FIG. 2 in a use state.
Figure 8:
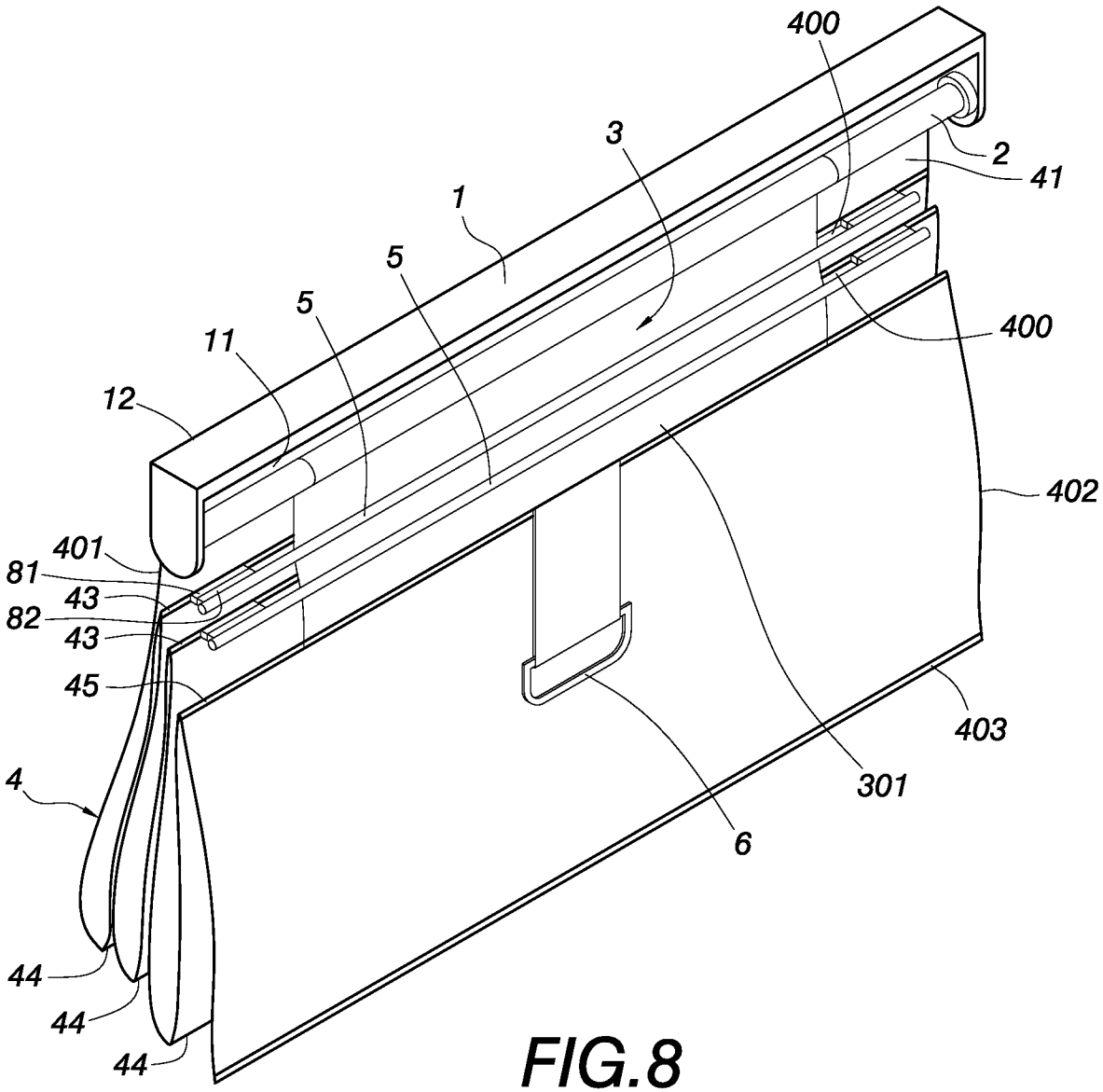
FIG. 8 is a perspective view of FIG. 2 in a further use state.

Please refer to FIG. 8 to FIG. 6 in sequence. When the Roman shade is to be unfolded, the user can pull the pull ring 6 at the bottom end 301 of the inner curtain fabric 3, so that the bottom end 301 of the inner curtain fabric 3 drives the third fold line portion 45 of the bottom end 402 of the outer curtain fabric 4 to move down. In the process, the inner curtain fabric 3 is attached to the inner surface 41 of the outer curtain fabric 4 through the plurality of limiting members 5 and the corresponding openings 400, and the outer curtain fabric 4 is moved downward smoothly, thereby unfolding the Roman shade stably and smoothly.

Figure 7:
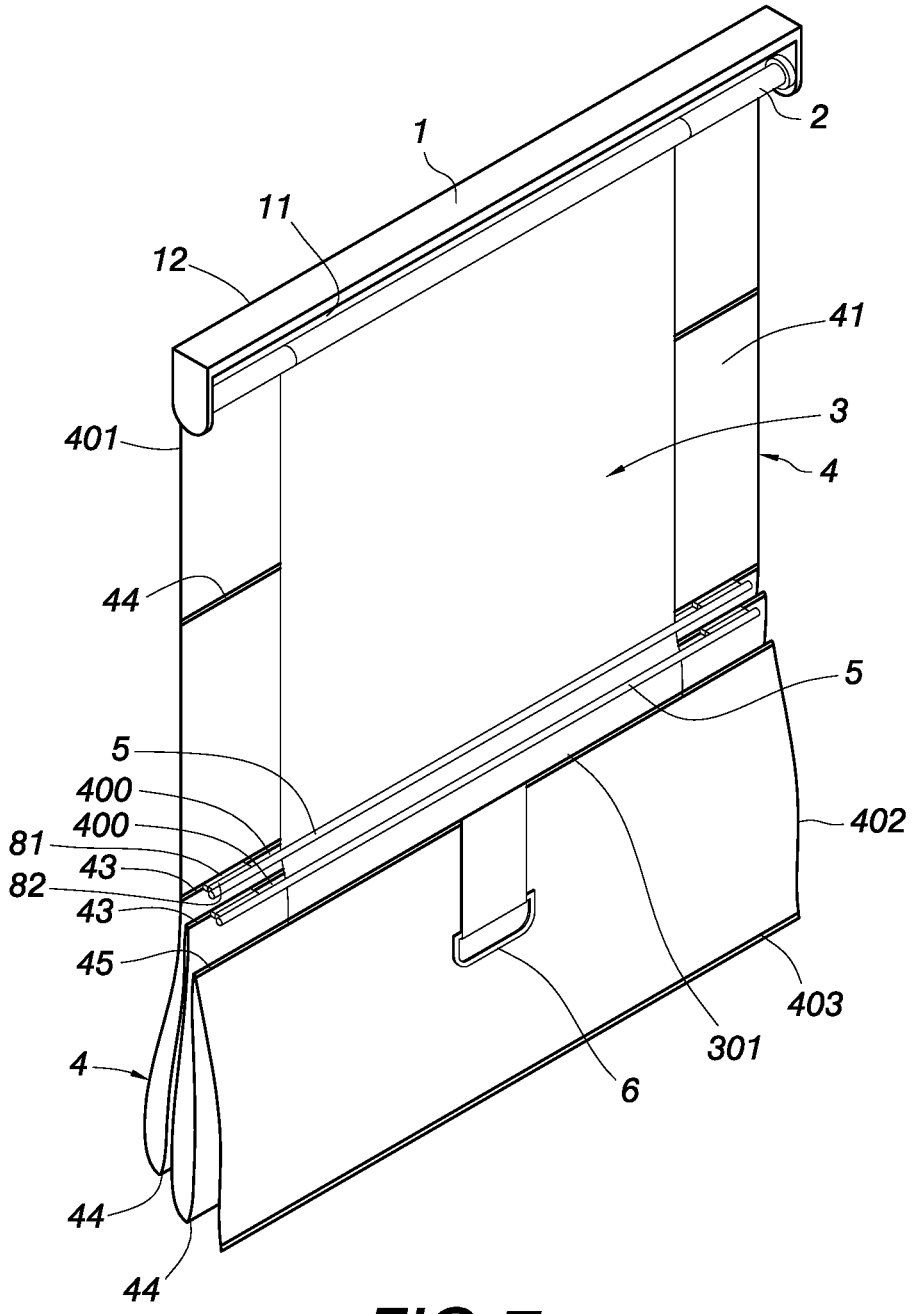
FIG. 7 is a perspective view of FIG. 2 in another use state.

Please refer to FIG. 6 to FIG. 8 in sequence. When the Roman shade is to be folded upward, the user can first pull the pull ring 6 at the bottom end 301 of the inner curtain fabric 3 and then release the pull ring 6, such that the roller tube 2 drives the third fold line portion 45 at the bottom end 402 of the outer curtain fabric 4 to move upward through the bottom end 301 of the inner curtain fabric 3.

When the bottom end 301 of the inner curtain fabric 3 is moved to touch the lowermost opening 400 of the outer curtain fabric 4, the limiting member 5 and the first folding line portion 43 of the outer curtain fabric 4 corresponding to the opening 400 are pushed up, such that the outer curtain fabric 4 is driven to be folded and overlapped from bottom to top along the third fold line portion 45, the respective first fold line portions 43 and the respective second fold line portions 44. The outer curtain fabric 4 is formed in a state of continuous parallel folding, thereby stably supporting and driving the Roman shade to be folded upward and overlapping one by one.

Accordingly, the respective two ends of the plurality of limiting members 5 can be quickly and easily mounted on the inner surface 41 of the outer curtain fabric 4 through the corresponding connected members 82 and the connecting members 81. It is easy to install, easy to operate, and stable after installation. The plurality of limiting members 5 are not exposed on the outer surface 42 of the outer curtain fabric 4 (referring to FIG. 1) to improve the appearance of the outer curtain fabric 4. The present invention improves the shortcomings of the prior art, for example, the U-shaped ring of the conventional Roman curtain is easy to affect the appearance, the assembly is time-consuming, and the stability is not good at the time of folding.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A double-layer Roman shade folding structure, comprising:

a bracket;

a roller tube pivotally connected to an inner side of the bracket;

an inner curtain fabric having a top end fixed to the roper tube and a bottom end extendable below the bracket;

an outer curtain fabric having a top end fixed to a front side of the bracket and a bottom end extendable below the bracket, the bottom end of the inner curtain fabric being fixed to an upper region of a bottom portion of the outer curtain fabric, the outer curtain fabric being provided with a plurality of first fold line portions that are arranged horizontally and spaced apart from each other, a plurality of second fold line portions that are arranged horizontally and spaced apart from each other and being disposed between the top end of the outer curtain fabric, the plurality of first fold line portions and the upper region of the bottom portion of the outer curtain fabric, the plurality of first fold line portions and the plurality of second fold line portions being arranged at equal intervals and in an alternating manner; and a plurality of limiting members, each detachably disposed on a surface of a respective first fold line portion facing the inner curtain fabric by way of detachably engaging connecting members respectively connected to the first fold line portions and to the limiting members, so that an opening is defined between the surface of each of the first fold line portions and a corresponding one of the limiting members for the inner curtain fabric to pass therethrough;

the roller tube enabling the bottom end of the outer curtain fabric to be pulled upward by the bottom end of the inner curtain fabric, wherein when the inner curtain fabric is moved up through the plurality of openings, the plurality of limiting members and the plurality of first fold line portions of the outer curtain fabric are pushed and moved up in sequence from bottom to top, and the outer curtain fabric is folded along the plurality of second fold line portions so that the outer curtain fabric is formed in a state of continuous parallel folding;

wherein the upper region of the bottom portion of the outer curtain fabric is provided with a third fold line portion, the bottom end of the inner curtain fabric fixed to the third fold hue portion, and each of the plurality of first fold line portions, the plurality of second fold line portions, the third fold line portion, and the bottom end of the outer curtain fabric is provided with a ballast member.

2. The double-layer Roman shade folding structure as claimed in claim 1, wherein opposing ends of each of the first fold line portions on the surface facing the inner curtain fabric, and two ends of a corresponding one of the limiting members, are provided with the respective connecting members, the connecting members comprising hook-and-loop fasteners or buckles to engage with each other.

3. The double-layer Roman shade folding structure as claimed in claim 2, wherein the limiting members are fiberglass rods.

4. The double-layer Roman shade folding structure as claimed in claim 2, wherein each of the limiting members is a fabric strip, and an outer surface of the fabric strip of the two ends of the limiting member are provided with the respective connecting members, the connecting members comprising hook-and-loop fasteners or buckles.

5. The double-layer Roman shade folding structure as claimed in claim 2, wherein each of the limiting members is a fiberglass rod wrapped with a fabric strip, and an outer surface of the fabric strip of the two ends of the limiting member are provided with the respective connecting members, the connecting members comprising hook-and-loop fasteners or buckles.

6. The double-layer Roman shade folding structure as claimed in claim 1, wherein the bottom end of the inner curtain fabric is provided with a pull ring.

* * * * *